US009541276B2

(12) United States Patent
Chin

(10) Patent No.: US 9,541,276 B2
(45) Date of Patent: Jan. 10, 2017

(54) LED LAMP HAVING A GOOD HEAT-DISSIPATING FUNCTION

(71) Applicant: Chi-Te Chin, Taichung (TW)

(72) Inventor: Chi-Te Chin, Taichung (TW)

(73) Assignee: ACMECOOLS TECH. LTD., Tortola (VG)

( * ) Notice: Subject to any disclaimer, the term of this patent is extended or adjusted under 35 U.S.C. 154(b) by 39 days.

(21) Appl. No.: 14/773,214

(22) PCT Filed: Mar. 8, 2013

(86) PCT No.: PCT/CN2013/000243

§ 371 (c)(1),
(2) Date: Sep. 4, 2015

(87) PCT Pub. No.: WO2014/134751

PCT Pub. Date: Sep. 12, 2014

(65) Prior Publication Data

US 2016/0010842 A1 Jan. 14, 2016

(51) Int. Cl.
*F21V 29/83* (2015.01)
*F21V 29/81* (2015.01)
(Continued)

(52) U.S. Cl.
CPC ..... *F21V 29/83* (2015.01); *F21K 9/30* (2013.01); *F21K 9/50* (2013.01); *F21V 1/00* (2013.01); *F21V 29/81* (2015.01); *F21W 2101/02* (2013.01); *F21W 2131/103* (2013.01); *F21Y 2101/02* (2013.01)

(58) Field of Classification Search
CPC ..... F21V 1/00; F21V 29/81; F21V 29/83; F21W 2131/103; F21K 9/30; F21K 9/50
See application file for complete search history.

(56) References Cited

U.S. PATENT DOCUMENTS 8,408,750 B2 * 4/2013 Chang ..... F21K 9/135 362/294
2005/0030753 A1 * 2/2005 Tickner ..... F21S 8/00 362/351

(Continued)

FOREIGN PATENT DOCUMENTS

CN 201057450 Y 5/2008
CN 201081205 Y 7/2008

(Continued)

*Primary Examiner* — Karabi Guharay
(74) *Attorney, Agent, or Firm* — Muncy, Geissler, Olds & Lowe, P.C.

(57) ABSTRACT

A LED lamp having a good heat-dissipating function includes a thermal radiator of solid metal including a top surface downwardly sloping from a peak point thereof to the border, a plurality of granular bumps raised from the top surface and defining a plurality of flow paths thereamong, a recess curved inwardly from a bottom surface thereof, an eave surrounding the recess and an inner slope located at the inner side of the eave and obliquely upwardly extended from the lowest edge of the eave to the recess, a vapor chamber bonded with the top surface thereof to the bottom surface of the recess, a circuit module bonded with the top surface thereof to the bottom surface of the vapor chamber, and a LED unit mounted at the bottom surface of the circuit module.

9 Claims, 8 Drawing Sheets

(51) Int. Cl.

| | |
|---|---|
| ***F21K 99/00*** | (2016.01) |
| ***F21V 1/00*** | (2006.01) |
| *F21W 101/02* | (2006.01) |
| *F21W 131/103* | (2006.01) |
| *F21Y 101/02* | (2006.01) |

(56) References Cited

U.S. PATENT DOCUMENTS

| | | | | |
|---|---|---|---|---|
| 2007/0086196 | A1* | 4/2007 | Wong | F21K 9/00 362/294 |
| 2013/0271998 | A1* | 10/2013 | Merschon | F21K 9/137 362/294 |

FOREIGN PATENT DOCUMENTS

| | | | |
|---|---|---|---|
| CN | 201666560 | U | 12/2010 |
| CN | 201748300 | U | 2/2011 |
| CN | 201836689 | U | 5/2011 |
| CN | 202216078 | U | 5/2012 |

* cited by examiner

LED LAMP HAVING A GOOD HEAT-DISSIPATING FUNCTION

BACKGROUND OF THE INVENTION

1. Field of the Invention

The present invention relates to LED lamp technology and more particularly, to a LED lamp having a good heat-dissipating function.

3. Description of the Related Art

Conventional outdoor LED (light-emitting diode) lamps (such as LED street lights) are designed for use in the outdoors. In consideration of the factors of wind, rain and sun and other environmental factors, an outer shell will be necessary to protect the internal light-emitting LED chip and the associated circuit board, preventing rainwater permeation to cause short circuits. Further, during the operation of a LED lamp, much latent heat will be produced. Therefore, conventional LED lamps are generally equipped with a heat sink or like means for quick dissipation of heat. However, because the heat sink and LED chip of a conventional LED lamp are mounted inside the outer shell, the air inside the outer shell cannot be effectively dissipated into the outside air, lowering heat dissipation performance and shortening the lifespan of the LED chip.

Some LED lamp manufacturers make radiation fins on the outer shell in a parallel manner (the radiation fins are of the known design and not indicated in the drawings), increasing the heat dissipation surface area of the outer shell so that the internal high temperature can be released, lowering the temperature of every internal component inside the outer shell. However, the heat dissipation effect of this arrangement is limited.

Further, arranging radiation fins on the outer surface of the outer shell tends to cause a dirt retention problem. According to conventional techniques, the radiation fins are arranged on the outer surface of the outer shell at denser spacings. When used outdoors, rainwater will fall to the gaps between the radiation fins, tree leaves, bird droppings and dust, etc. are likely to be stuck in between the radiation fins. When stayed long, dirt can be consolidated and will not be washed away by rainwater. Dirt can obscure the surfaces of the radiation fins that are disposed in contact with air, lowering the heat dissipation efficiency of the radiation fins.

SUMMARY OF THE INVENTION

The present invention has been accomplished under the circumstances in view. It is the main object of the present invention to provide a LED lamp having a good heat-dissipating function, which achieves a better heat dissipation effect than conventional LED lamps.

It is another object of the present invention to provide a LED lamp having a good heat-dissipating function, which is practical for outdoor application without an outer shell.

It is still another object of the present invention to provide a LED lamp having a good heat-dissipating function, which prevents leaves or bird droppings from sticking in the top surface thereof, effectively letting rainwater flow and thus maintaining good heat dissipation.

To achieve these and other objects of the present invention, a LED lamp having a good heat-dissipating function comprises a thermal radiator of solid metal, a vapor chamber, a circuit module, and at least one LED unit. The thermal radiator comprises a top surface, an opposing bottom surface, a peak point located at the top surface, the top surface sloping from the peak point to the border of the thermal radiator, a plurality of bumps in a granular shape raised from and distributed over the top surface, a plurality of flow paths defined on the top surface by the bumps and sloping downwardly in direction from the peak point to the border of the thermal radiator, a recess inwardly curved from the bottom surface and having a planar bottom surface, an eave surrounding the recess, and an inner slope located at an inner side of the eave and extending obliquely upwardly from the lowest edge of the eave to the recess. The vapor chamber has the top surface thereof bonded to the planar bottom surface of the recess. The circuit module is bonded with the top surface thereof to the bottom surface of the vapor chamber. The at least one LED unit is mounted at the bottom side of the circuit module.

The thermal radiator provides a large heat dissipation surface area for quick heat dissipation, so that the LED lamp of the prevent invention achieves a better heat dissipation effect than conventional LED lamps, and is practical for outdoor application without an outer shell. Further, the arrangement of the bumps and the flow paths prevents leaves or bird droppings from sticking in the top surface 12 of the thermal radiator 11, effectively letting rainwater flow and thus maintaining good heat dissipation.

Preferably, the peak point is located at the center of the top surface of the thermal radiator.

Preferably, the bumps are configured to exhibit a round bead shape, a roof tile shape, or a hill-like shape.

Preferably, the LED lamp further comprises a lampshade upwardly fastened to the bottom surface of the thermal radiator and covered over the LED unit, the circuit module and the vapor chamber. The lampshade has a plurality of air vents.

Preferably, the LED lamp further comprises a set of external terminals electrically connected to the circuit module for connecting to an external power source. Preferably, the flow paths are located on the top surface of the thermal radiator and arranged in a radial manner or randomly arranged in a staggered manner.

Preferably, the LED lamp further comprises a heat transfer medium set between the vapor chamber and the thermal radiator. Preferably, the vapor chamber is detachably fastened to the thermal radiator by a plurality of fasteners.

Preferably, the circuit module is selectively made in the form of a circuit board, printed circuit or circuit chip bonded to or printed on the bottom surface of said vapor chamber and carrying said at least one LED unit thereon.

Preferably, the height of the bumps is smaller than the width of the flow path.

Other advantages and features of the present invention will be fully understood by reference to the following specification in conjunction with the accompanying drawings, in which like reference signs denote like components of structure.

DETAILED DESCRIPTION OF THE INVENTION

Figure 1:
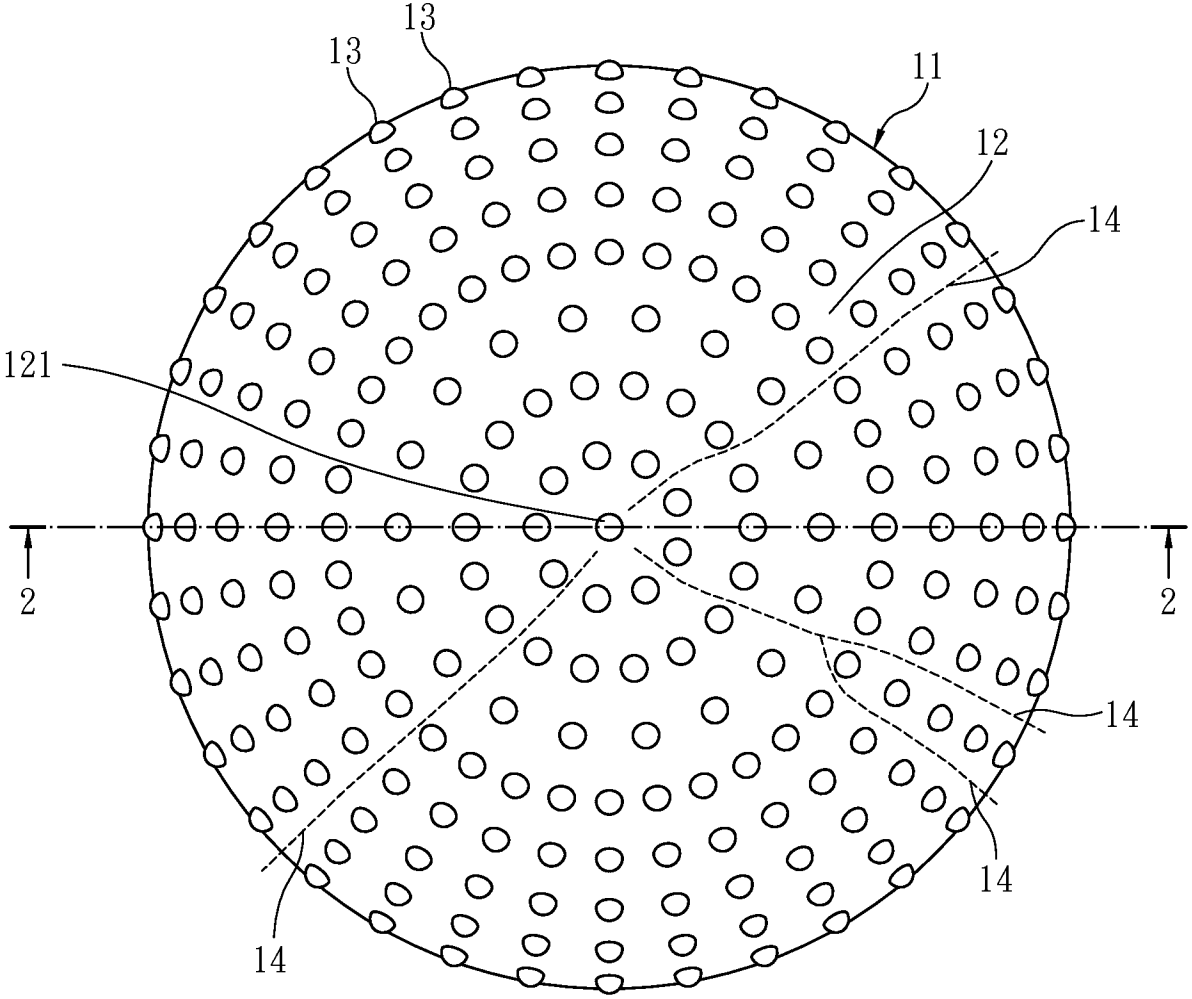
FIG. 1 is a top view of a LED lamp having a good heat-dissipating function in accordance with a first embodiment of the present invention.
Figure 2:
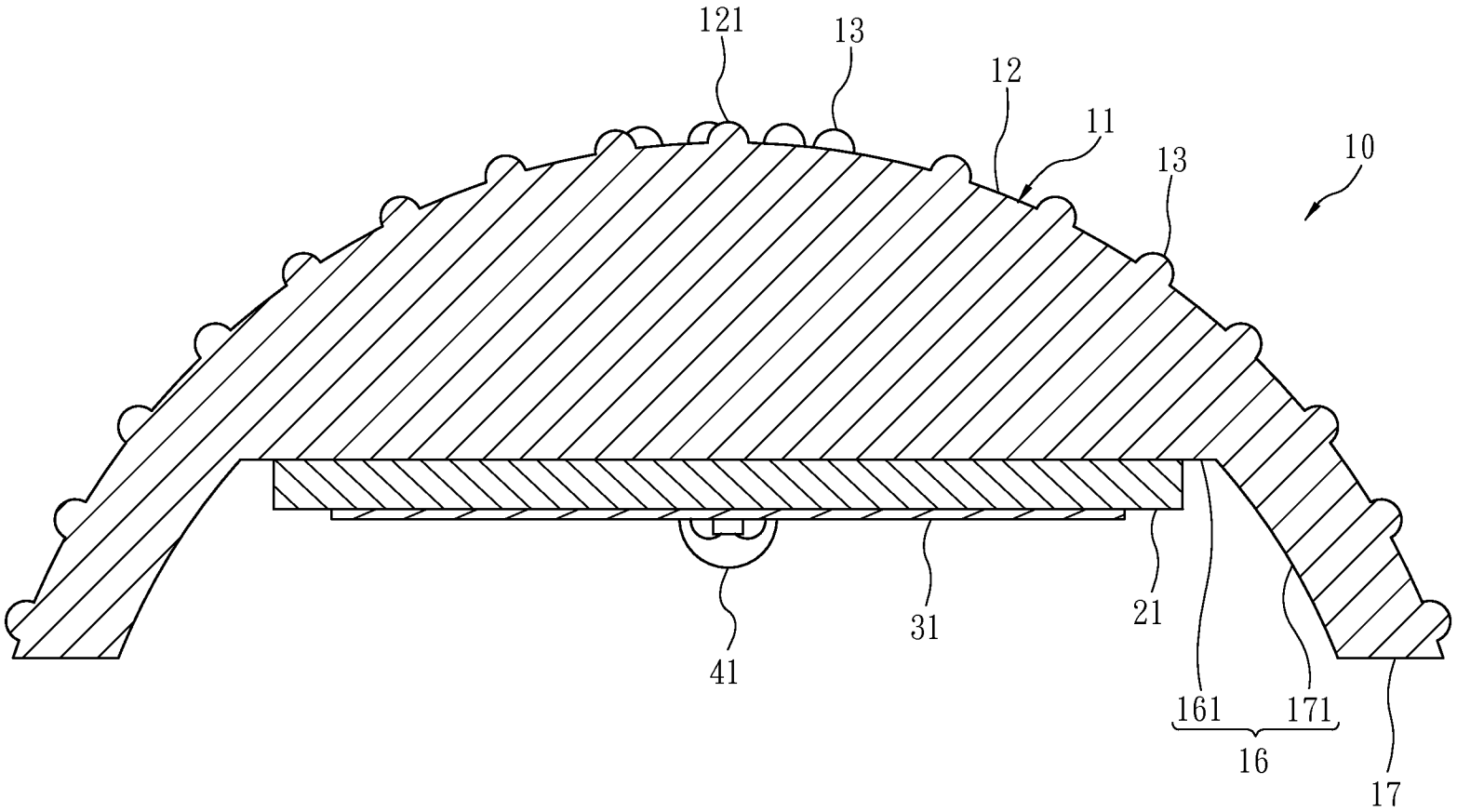
FIG. 2 is a sectional view taken along line 2-2 of FIG. 1.
Figure 3:
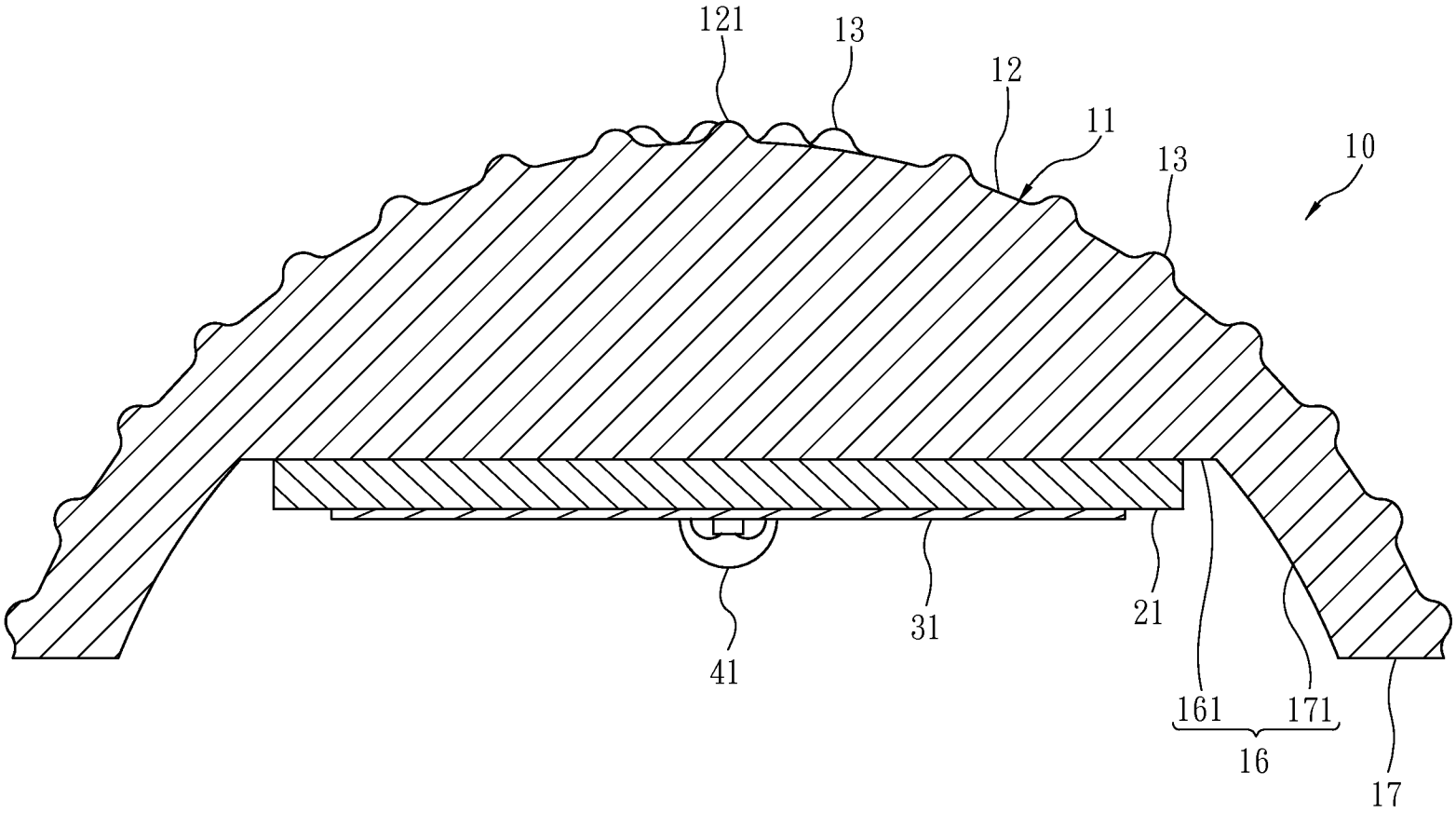
FIG. 3 is similar to FIG. 2, illustrating a different shape of bumps.
Figure 4:
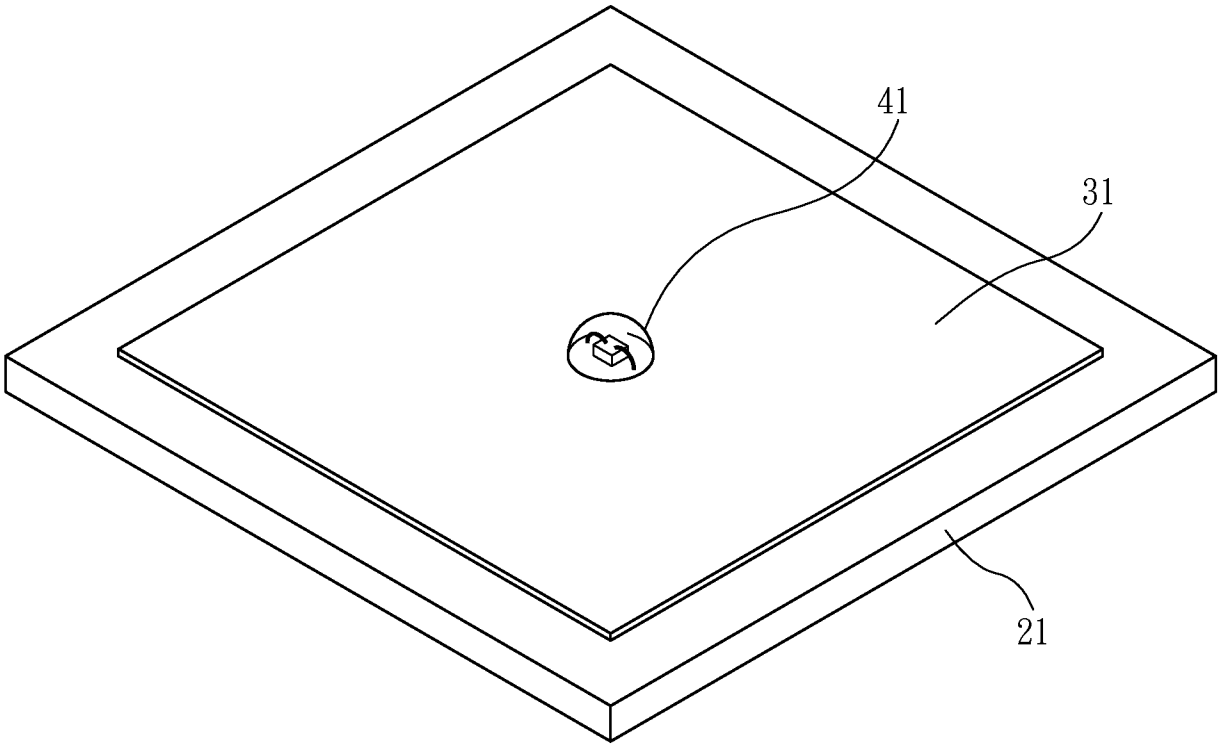
FIG. 4 is an elevational assembly view of a part of the present invention, illustrating the vapor chamber, the circuit module and the LED unit assembled.
Figure 5:
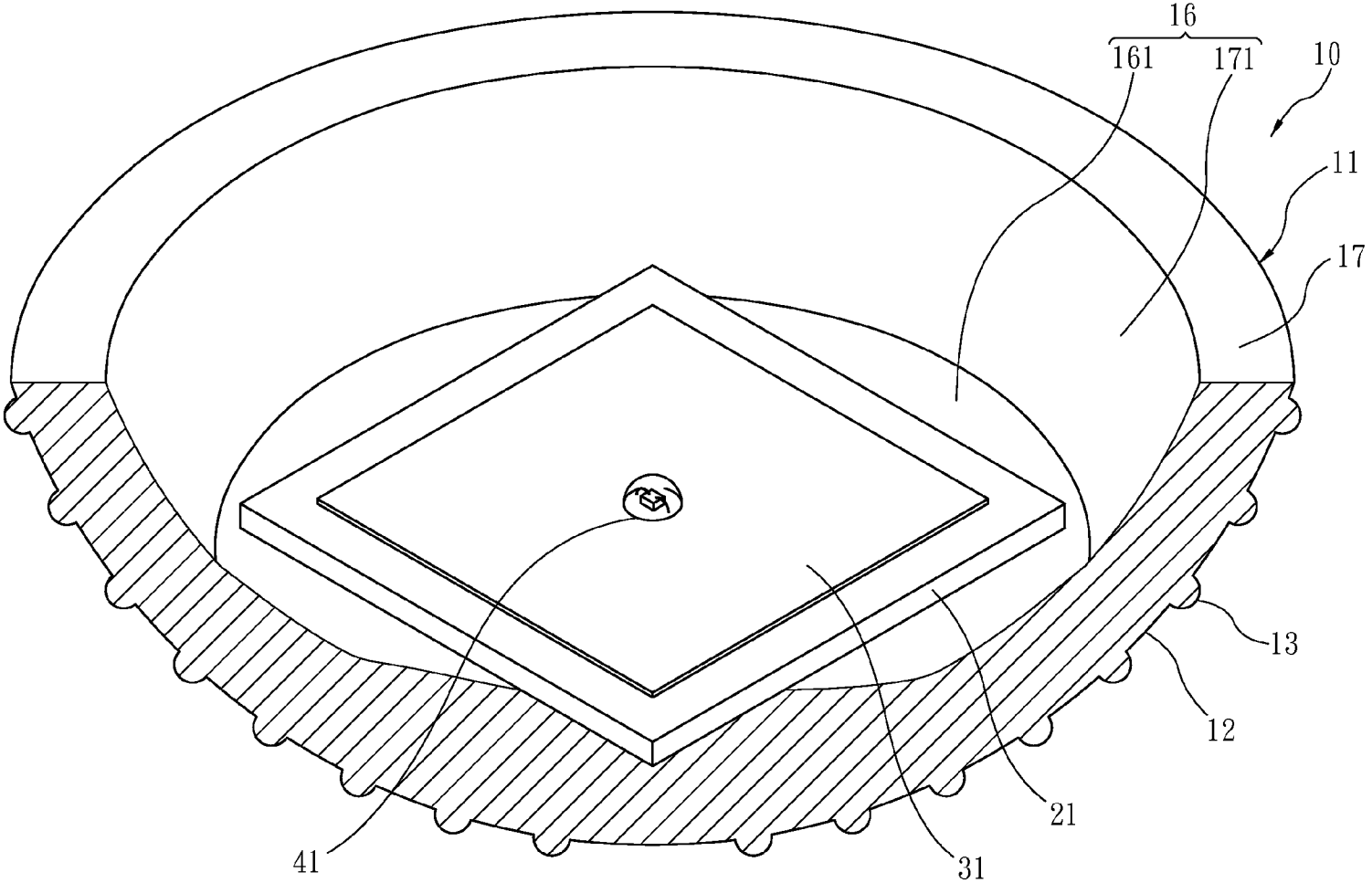
FIG. 5 is a bottom elevational view of the first embodiment of the present invention, illustrating the thermal radiator in sectional elevation.
Figure 6:
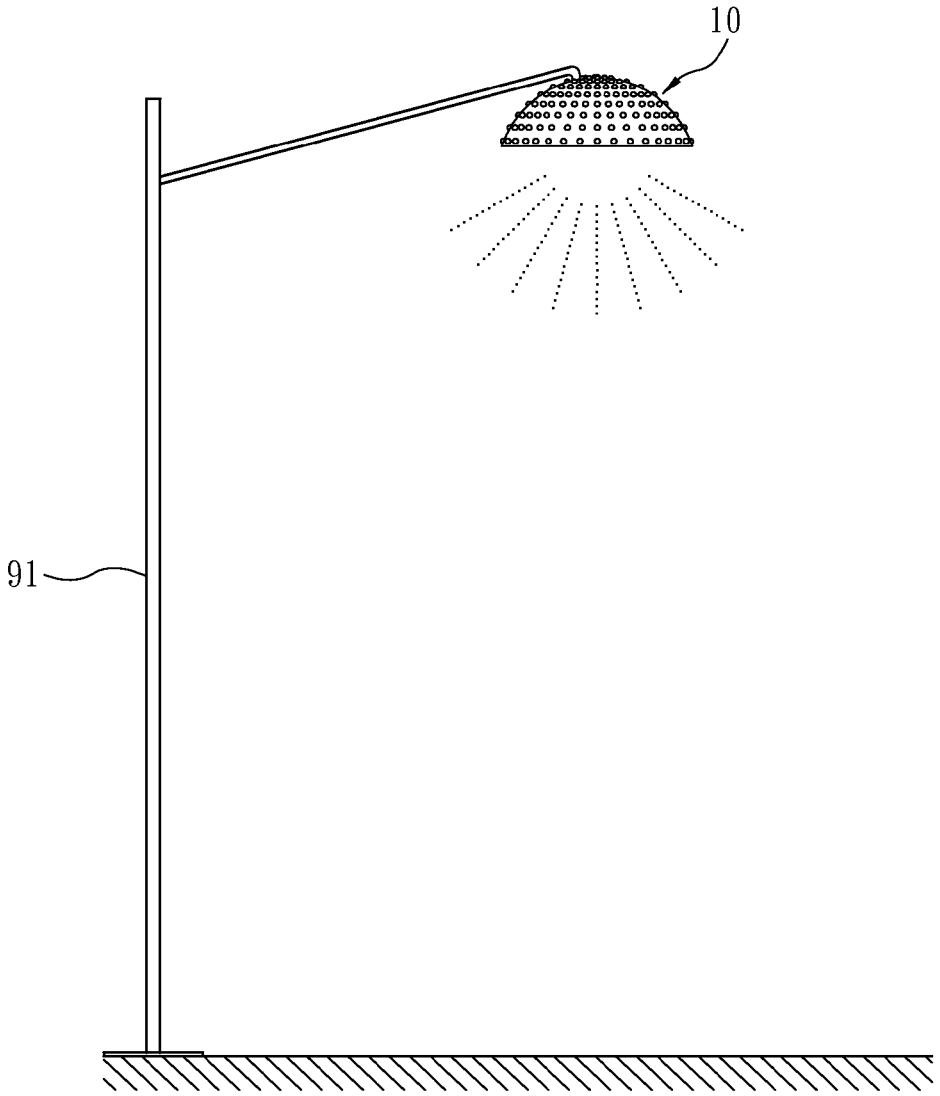
FIG. 6 is an applied view of the LED lamp having a good heat-dissipating function in accordance with the first embodiment of the present invention.

Referring to FIGS. 1-5, a LED lamp having a good heat-dissipating function 10 in accordance with the present invention is shown. The LED lamp 10 comprises a thermal radiator 11, a vapor chamber 21, a circuit module 31 and at least one LED unit 41.

The thermal radiator 11 is a solid metal member made by, for example, casting, comprising a top surface 12 located at a top side thereof and a bottom surface 16 located at an opposing bottom side thereof. The top surface 12 has a peak point 121 at the highest point. The top surface 12 slopes radially and downwardly from the peak point 121 to the border thereof. The thermal radiator 11 further comprises a plurality of bumps 13 raised from the top surface 12. These bumps 13 are made in a granular shape and distributed over the top surface 12, defining a plurality of flow paths 14 on the top surface 12 thereamong. These flow paths 14 slope downwardly in direction from the peak point 121 toward the border of the thermal radiator 11. The bottom surface 16 curves upwards, defining a recess 161. The recess 161 has a planar bottom surface. The thermal radiator 11 extends downwardly along the border of the recess 161, forming an eave 17 that surrounds the recess 161 and an inner slope 171 that is located at an inner side of the eave 17 and extends obliquely upwardly from the lowest edge of the eave 17 to the recess 161. In this embodiment, the thermal radiator 11 is shaped like a dome. Alternatively, the thermal radiator 11 can be shaped like a cone, made in any other shape having a relatively higher center area and a relatively lower border area.

The peak point 121 of the thermal radiator 11 can be located anywhere on the top surface 12 according to different design requirements. In this embodiment, the peak point 121 is located at the center of the top surface 12. Further, the bumps 13 can be variously shaped, such as round bead shape, hill-like shape, or any other shape. In the example shown in FIG. 2, the bumps 13 have a round bead shape. In the example shown in FIG. 3, the bumps 13 have a hill-like shape. Further, in this embodiment, the flow paths 14 are arranged on the top surface 12 in a radial manner, further, in FIG. 1, the dotted lines indicate multiple flow paths.

The vapor chamber 21 is bonded with a top surface thereof to the bottom surface of the recess 161. The vapor chamber 21 is based on the same theory as conventional heat pipes. It is a vacuum vessel with a wick structure lining the inside walls that is saturated with a working fluid.

The circuit module 31 has a top surface thereof bonded to an opposing the bottom surface of the vapor chamber 21. The circuit module 31 can be made in the form of a circuit board, printed circuit or circuit chip bonded to or printed on the bottom surface of the vapor chamber 21, comprising at least one LED unit 41. In this embodiment, the circuit module 31 is made in the form of a circuit board.

In this embodiment, the number of the at least one LED unit 41 is 1, and this LED unit 41 is located at an opposing bottom surface of the circuit module 31. The LED chip and encapsulation structure of the LED unit 41 are of the known art, no further detailed description in this regard will be necessary.

After understanding the physical architecture of the first embodiment of the present invention, the application of LED lamp having a good heat-dissipating function 10 is outlined hereinafter.

Referring to FIGS. 1-6, before using the LED lamp having a good heat-dissipating function 10, fasten the thermal radiator 11 to a support 91, for example, upright post, keeping the LED unit 41 in a downward facing position.

When in use, the LED unit 41 emits light downward. The heat energy generated during the operation of the LED unit 41 is transferred by the circuit module 31 to the vapor chamber 21 that spreads heat energy efficiently, enabling heat energy to be rapidly transferred to the thermal radiator 11 and then dissipated into the outside open air through the large heat dissipation surface area of the thermal radiator 11. When it rains, rainwater flows along the flow paths 14 on the top surface 12 of the thermal radiator 11 and then drip by the eave 17. Subject to the design of the inner slope 171 of the eave 17, rainwater drips by the eave 17 and is prohibited from flowing to the vapor chamber 21 and the circuit module 31, avoiding short circuits. Further, the bead shape of the bumps 13 mates with the design of flow paths 14 to prevent leaves or bird droppings from sticking in the top surface 12 of the thermal radiator 11, effectively letting rainwater flow and thus maintaining good heat dissipation. If the LED lamp of the invention is used indoors, the design of the granular bumps and flow paths of the thermal radiator 11 prevents dust sticking to the thermal radiator 11, maintaining good heat dissipation.

Thus, the first embodiment of the present invention can achieve the effects as follows: 1. The invention achieves better heat dissipation effect than conventional LED lamps. 2. The invention is practical for outdoor application without an outer shell. 3. The design of the bumps 13 at the top surface 12 of the thermal radiator 11 prevents leaves or bird droppings from sticking to the surface of the radiator 11, effectively letting rainwater flow and thus maintaining good heat dissipation.

Figure 7:
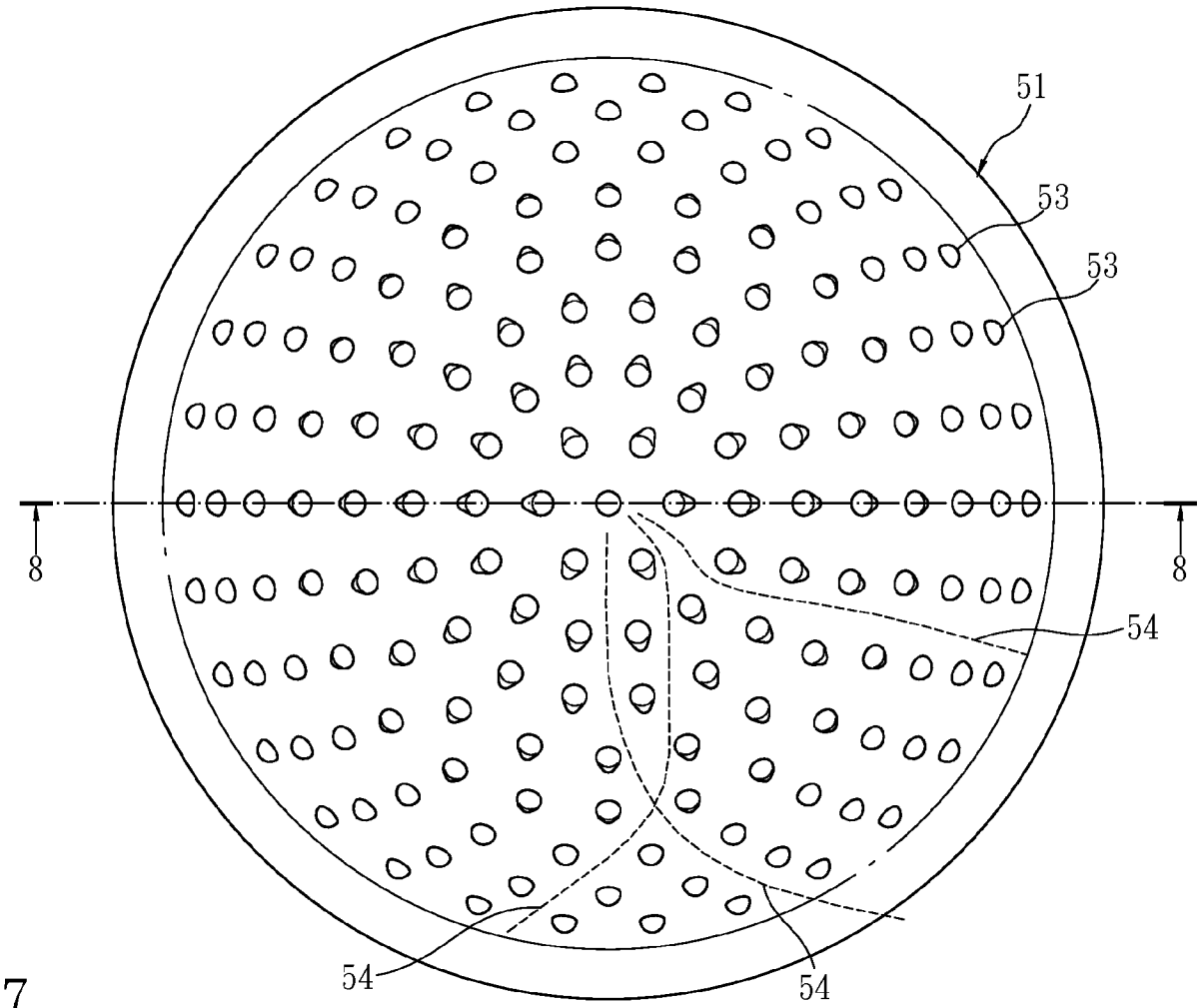
FIG. 7 is a top view of a LED lamp having a good heat-dissipating function in accordance with a second embodiment of the present invention.
Figure 8:
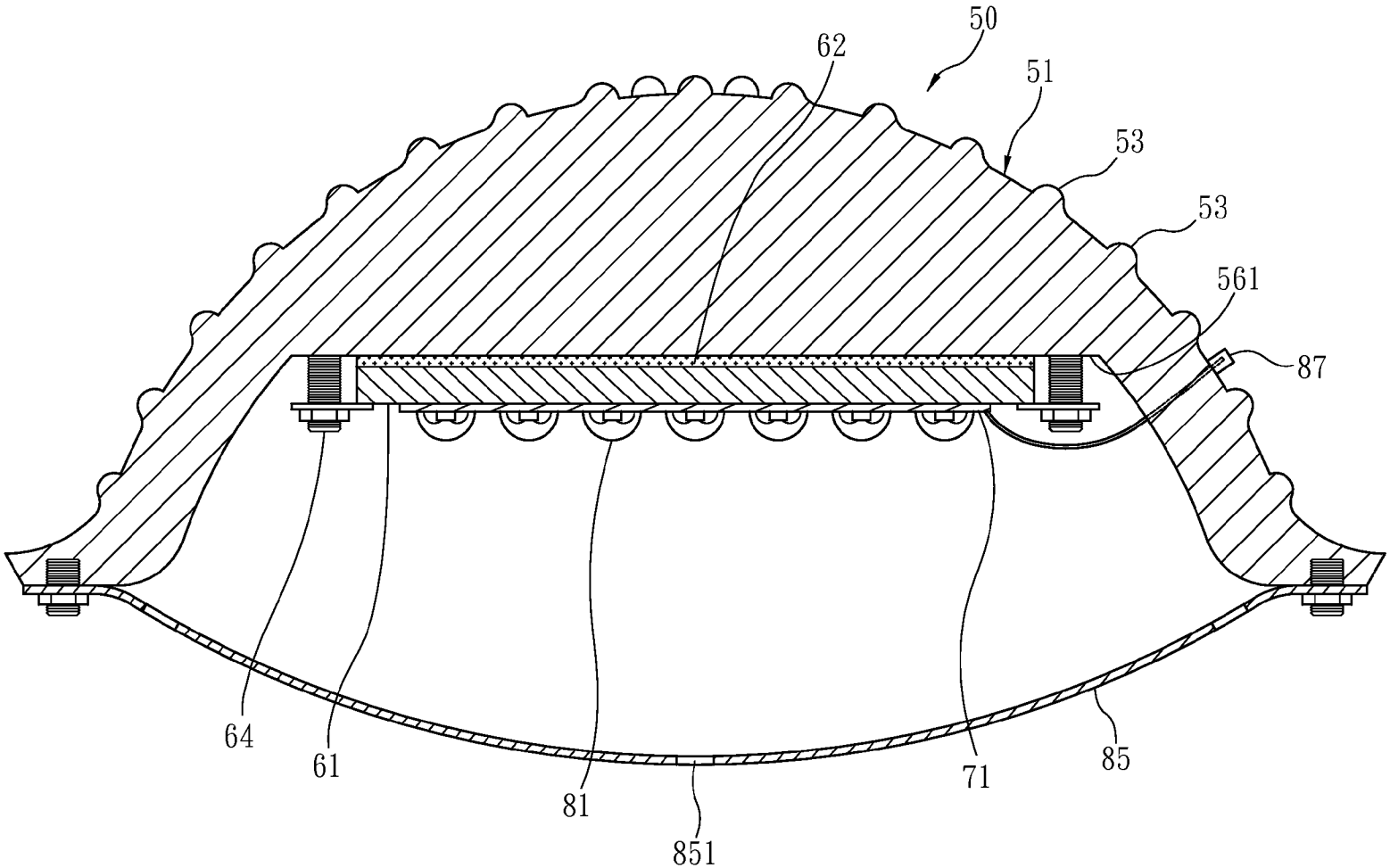
FIG. 8 is a sectional view taken along line 8-8 of FIG. 7.

Referring to FIGS. 7 and 8, a LED lamp having a good heat-dissipating function 50 in accordance with a second embodiment of the invention is shown. This second embodiment is substantially similar to the aforesaid first embodiment with the exceptions as follows:

Unlike the bead shape of the bumps 13 of the aforesaid first embodiment, the bumps 53 of this second embodiment exhibit a water-drop shape.

Unlike the radial arrangement of the flow paths of the aforesaid first embodiment, the flow paths 54 of this second embodiment are located at the top surface of the thermal radiator 51 and randomly arranged in a staggered manner, providing a greater variety of flow paths.

A heat transfer medium 63, such as thermal paste, tin solder or heat patch is set between the thermal radiator 51 and the vapor chamber 61, and bonded to a part of the bottom surface of the recess 561 of the thermal radiator 51 and a part of the top surface of the vapor chamber 61. The arrangement of the heat transfer medium 63 greatly increases the contact surface area between the thermal radiator 51 and the vapor chamber 61, enhancing heat dissipation.

The vapor chamber 61 is detachably fastened to the thermal radiator 51 by a plurality of fasteners 64. The fasteners 64 are common components commercially available, description of their detailed structure will not be necessary. The use of the fasteners 64 facilitates convenient installation of the vapor chamber 61.

The height of the bumps 53 from the top surface of the thermal radiator 51 is slightly smaller than the width of the flow path 54. Thus, the bumps 53 will not be too high, less likely to bind leaves and other debris.

The at least one LED unit 81 in this second embodiment is multiple.

This second embodiment further comprises a lampshade 85 and a set of external terminals 87.

Further, the lampshade 85 is upwardly fastened to the bottom surface of the thermal radiator 51 and covered over the LED unit 81, the circuit module 71 and the vapor chamber 61. The lampshade 85 can light-transmissive panel of transparent or translucent material, or a translucent diffuser panel, providing extra protection to the LED unit 81, the circuit module 71 and the vapor chamber 61. Further, the lampshade 85 has a plurality of air vents 851, for allowing communication between the air inside the lampshade 85 and the air outside the lampshade 85, or causing convection with the outside air.

The set of external terminals 87 is electrically connected to the circuit module 71 for connecting to an external power source, facilitating power source connection.

It is to be noted that the lampshade 85 can be coated with a layer of thermal paint (not shown) for transferring heat to the thermal radiator 51 to enhance heat dissipation. Alternatively, the lampshade can be coated with a layer of diffuser coating (not shown), or the lampshade can be configured to provide a light diffusing surface (like the surface of a lampshade for vehicle light) for diffusing the light emitted by the LED unit 81.

The other structure details and effects of this second embodiment are same as the aforesaid first embodiment, and therefore, no further detailed description in this regard will be necessary.

Further, in the aforesaid first and second embodiments of the invention, the circuit module, the LED unit and/or the thermal radiator can be coated with a layer of waterproof coating to enhance waterproofing effect. Because this waterproof layer coating technique is of the known art, it is not illustrated in the drawings.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A LED lamp having a good heat-dissipating function, comprising:

a thermal radiator of solid metal, said thermal radiator comprising a top surface, an opposing bottom surface, a peak point located at the top surface of said thermal radiator, the top surface of said thermal radiator sloping from said peak point to the border of said thermal radiator, a plurality of bumps in a granular shape raised from and distributed over the top surface of said thermal radiator, a plurality of flow paths defined on the top surface of said thermal radiator by said bumps and sloping downwardly in direction from said peak point to the border of said thermal radiator, a recess inwardly curved from the bottom surface of said thermal radiator, said recess having a planar bottom surface, an eave surrounding said recess, and an inner slope located at an inner side of said eave and extending obliquely upwardly from the lowest edge of said eave to said recess;

a vapor chamber having opposing top and bottom surfaces, the top surface of said vapor chamber being bonded to the planar bottom surface of said recess;

a circuit module having opposing top surface and bottom surface, the top surface of said circuit module being bonded to the bottom surface of said vapor chamber; and at least one LED unit mounted at the bottom side of said circuit module wherein the height of each said bump is smaller than the width of each said flow path.

2. The LED lamp having a good heat-dissipating function as claimed in claim 1, wherein said peak point is located at the center of said top surface.

3. The LED lamp having a good heat-dissipating function as claimed in claim 1, further comprising a lampshade upwardly fastened to the bottom surface of said thermal radiator and covered over said LED unit, said circuit module and said vapor chamber, said lampshade comprising a plurality of air vents.

4. The LED lamp having a good heat-dissipating function as claimed in claim 3, wherein said lampshade has an inner surface thereof coated with a layer of thermal paint.

5. The LED lamp having a good heat-dissipating function as claimed in claim 1, further comprising at least one external terminal, electrically connected to said circuit module for the connection of an external power source.

6. The LED lamp having a good heat-dissipating function as claimed in claim 1, wherein said flow paths are located on said top surface and arranged in a radial manner or randomly arranged in a staggered manner.

7. The LED lamp having a good heat-dissipating function as claimed in claim 1, further comprising a heat transfer medium set between said vapor chamber and said thermal radiator.

8. The LED lamp having a good heat-dissipating function as claimed in claim 1, wherein said vapor chamber is detachably fastened to said thermal radiator by a plurality of fasteners.

9. The LED lamp having a good heat-dissipating function as claimed in claim 1, wherein said circuit module is selectively made in the form of a circuit board, printed circuit or circuit chip bonded to or printed on the bottom surface of said vapor chamber and carrying said at least one LED unit thereon.

* * * * *